US010414469B1

(12) United States Patent
Smaracko

(10) Patent No.: US 10,414,469 B1
(45) Date of Patent: Sep. 17, 2019

(54) SPRING-LOADED WAKEBOARD BOOSTER

(71) Applicant: Steven Smaracko, East Stroudsburg, PA (US)

(72) Inventor: Steven Smaracko, East Stroudsburg, PA (US)

( * ) Notice: Subject to any disclaimer, the term of this patent is extended or adjusted under 35 U.S.C. 154(b) by 0 days.

(21) Appl. No.: 16/210,250

(22) Filed: Dec. 5, 2018

(51) Int. Cl.
*B63B 35/85* (2006.01)
*B63B 35/81* (2006.01)

(52) U.S. Cl.
CPC ..... *B63B 35/816* (2013.01); *B63B 35/85* (2013.01); *B63B 2035/818* (2013.01)

(58) Field of Classification Search
CPC ..... B63B 35/85; B63B 35/816; B63B 35/818
See application file for complete search history.

(56) References Cited

U.S. PATENT DOCUMENTS 1,615,568 A 1/1927 Carroll
2,128,030 A * 8/1938 Koleno ..... E04H 17/04 256/39
2,856,077 A * 10/1958 Stanton, Jr. ..... D06F 53/02 211/119.09
4,624,141 A * 11/1986 Soleau ..... B63B 35/815 116/26
4,955,309 A 9/1990 Ciccone
4,986,784 A 1/1991 French
5,307,753 A * 5/1994 Besonen, Sr. ..... B63B 21/20 114/230.18
5,482,258 A * 1/1996 Clauson ..... F16F 7/00 114/230.2
5,694,879 A 12/1997 Taylor
6,158,374 A * 12/2000 Free, Jr. ..... B63B 21/00 114/215
6,367,785 B1 * 4/2002 Nakabayashi ..... F16F 9/0218 267/226
7,025,644 B2 4/2006 Geier et al.
7,114,457 B1 * 10/2006 Stiers ..... A63B 69/0093 114/253
7,717,053 B2 5/2010 Jayne
9,108,706 B2 * 8/2015 Doerr ..... B63B 35/816
9,302,742 B2 * 4/2016 Williams ..... B63B 35/815
2005/0260902 A1 11/2005 Geir et al.
2006/0027155 A1 * 2/2006 Welch ..... B63B 35/816 114/254
2012/0167812 A1 * 7/2012 Walker ..... B63B 35/73 114/124
2014/0263795 A1 * 9/2014 Doerr ..... B63B 35/816 242/371

* cited by examiner

*Primary Examiner* — S. Joseph Morano
*Assistant Examiner* — Jovon E Hayes
(74) *Attorney, Agent, or Firm* — Thomas J. Germinario

(57) ABSTRACT

A spring-loaded wakeboard booster has a vertical swivel connection to the towing tower of a motorboat at its proximal end. The swivel connection rotatably supports a cylindrical piston spring assembly, which has a tow rope connection shaft at its proximal end, through which the piston spring assembly is connected by a tow line extending to the wakeboard. When the wakeboard is being towed, the force on the tow line draws the piston toward the proximal end of the piston spring assembly, thereby compressing the spring. When the wakeboard reaches the crest of the boat's wake, the water resistance drops and the spring expands, drawing the board forward and over the wake.

2 Claims, 4 Drawing Sheets

SPRING-LOADED WAKEBOARD BOOSTER

FIELD OF INVENTION

The present invention relates to the general field of water sport equipment, and more particularly to wakeboarding equipment.

BACKGROUND OF THE INVENTION

Wakeboarding is an increasingly popular water sport, in which a rider maneuvers the board through the wake generated by a towing motor boat. The sport combines techniques of water skiing, snowboarding and surfing. Many of these techniques involve riding up the wake so that the energy of the wake launches the rider into the air, enabling the rider can do various airborne tricks.

One disadvantage of conventional wakeboard is the inability to harness the energy expended in mounting the wake to increase the height of the jump at the crest of the wake. What is needed is a device for use with the wakeboard that stores this energy until its ready to be released at the launch point.

SUMMARY OF THE INVENTION

As used herein and in the claims which follow, a "wakeboard" is defined as a buoyant, substantially flat, oblong board that is adapted for being towed by a motorboat and for riding through and upon a wake generated by the towing motorboat. "Proximal" indicates the direction toward the wakeboard, while "distal" indicates the direction opposite the wakeboard. "Top" and "upper" designate the direction opposite the water surface, while "bottom" and "lower" designate the direction toward the water surface.

The present invention is a spring-loaded wakeboard booster equipped with a piston spring mechanism, which comprises a helical spring axially aligned within a substantially horizontal cylindrical spring housing and confined between a piston head and the proximal end of the spring housing. The piston head moves from the distal end toward the proximal end of the spring housing by the action of a piston rod, the proximal terminus of which is connected to the wakeboard's tow rope through a connector shaft extending from the proximal end of the spring housing. The spring housing is supported by a swivel support which extends perpendicularly from the lower face of the spring housing and rotatably attaches to the top surface of the towing tower on the motorboat. The swivel support allows the rider of the wakeboard to maneuver the board to the right or left of the direction of the towing force, thereby changing the board's angle of attack to the wake.

The piston spring mechanism operates to store energy in the spring while the board is cutting through the wake, because the wake resistance pulls the piston rod and the piston head toward the proximal end of the spring housing and thereby compresses the spring. When the board reaches the crest of the wake, the wake resistance diminishes, reducing the pull on the piston rod and allowing the spring to expand. The reaction force of the piston head springing backward impels the board forward over the crest of the wake and into the air.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
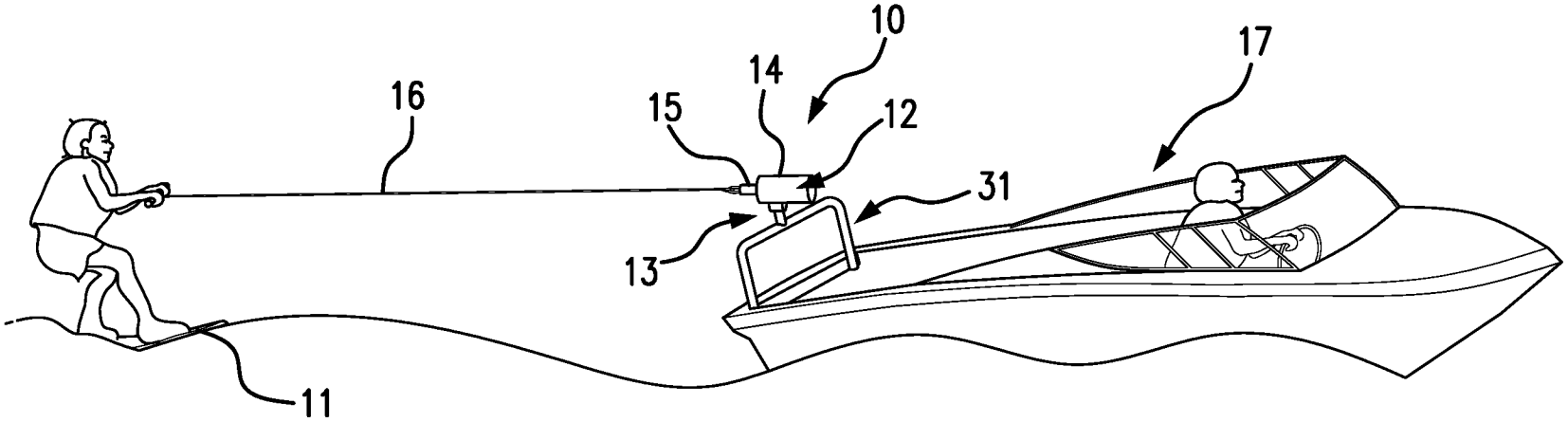
FIG. 1 is a side profile view of an exemplary spring-loaded wakeboard booster, according to one embodiment of the present invention, showing a wakeboard being towed through a wake generated by a towing motorboat.

Referring to FIG. 1, the exemplary embodiment of the spring-loaded wakeboard booster 10 comprises the piston spring mechanism 12 rotatably attached to the towing tower 31 of a motorboat 17 by the swivel support 13. The cylindrical outer covering of the piston spring mechanism comprises the spring housing 14, from the proximal end of which extends the tow rope connector shaft 15, to which the tow rope 16 from the towing motorboat 17 is connected.

Figure 2:
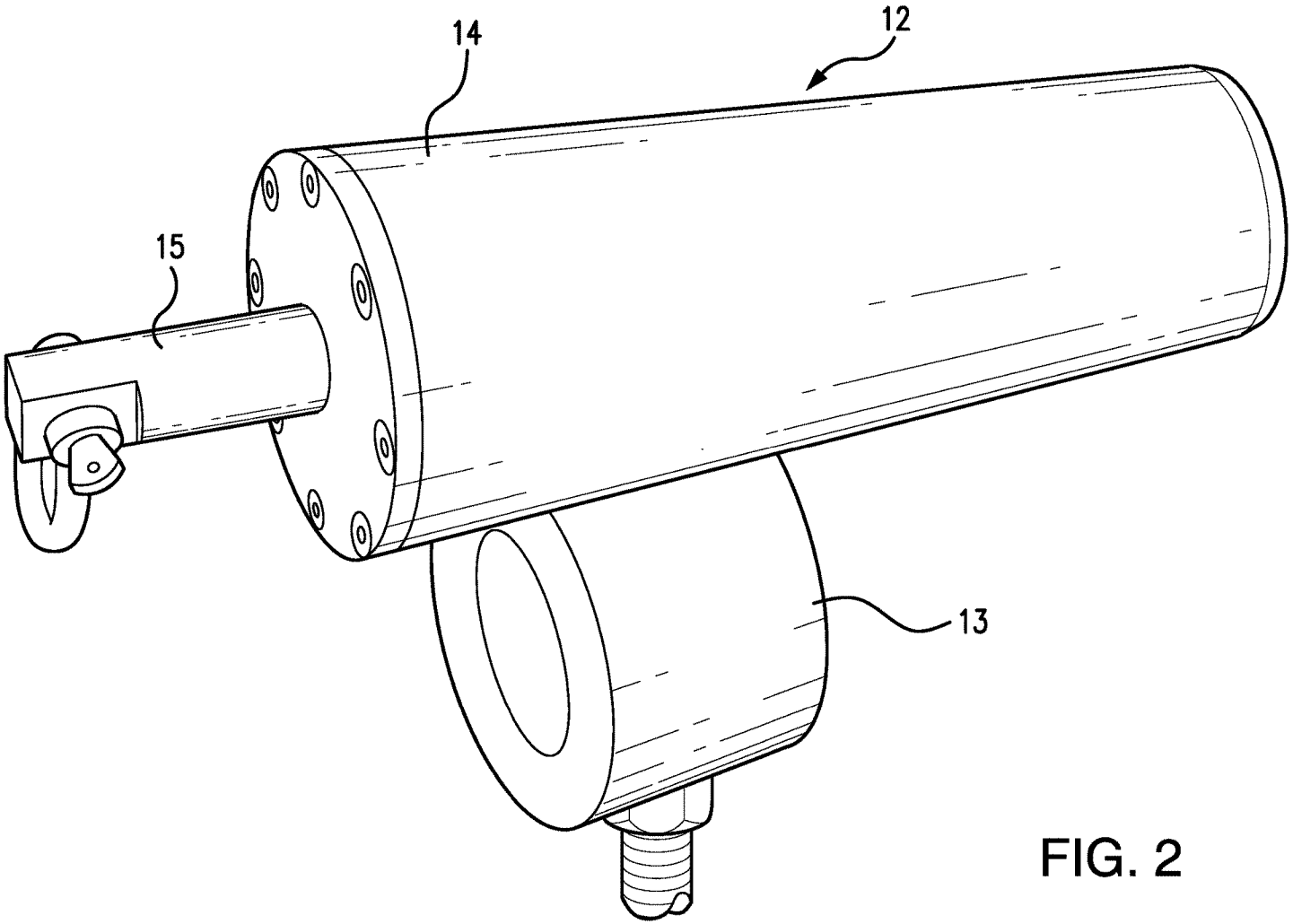
FIG. 2 is a front perspective view of an exemplary piston spring mechanism according to one embodiment of the present invention.
Figure 3A:
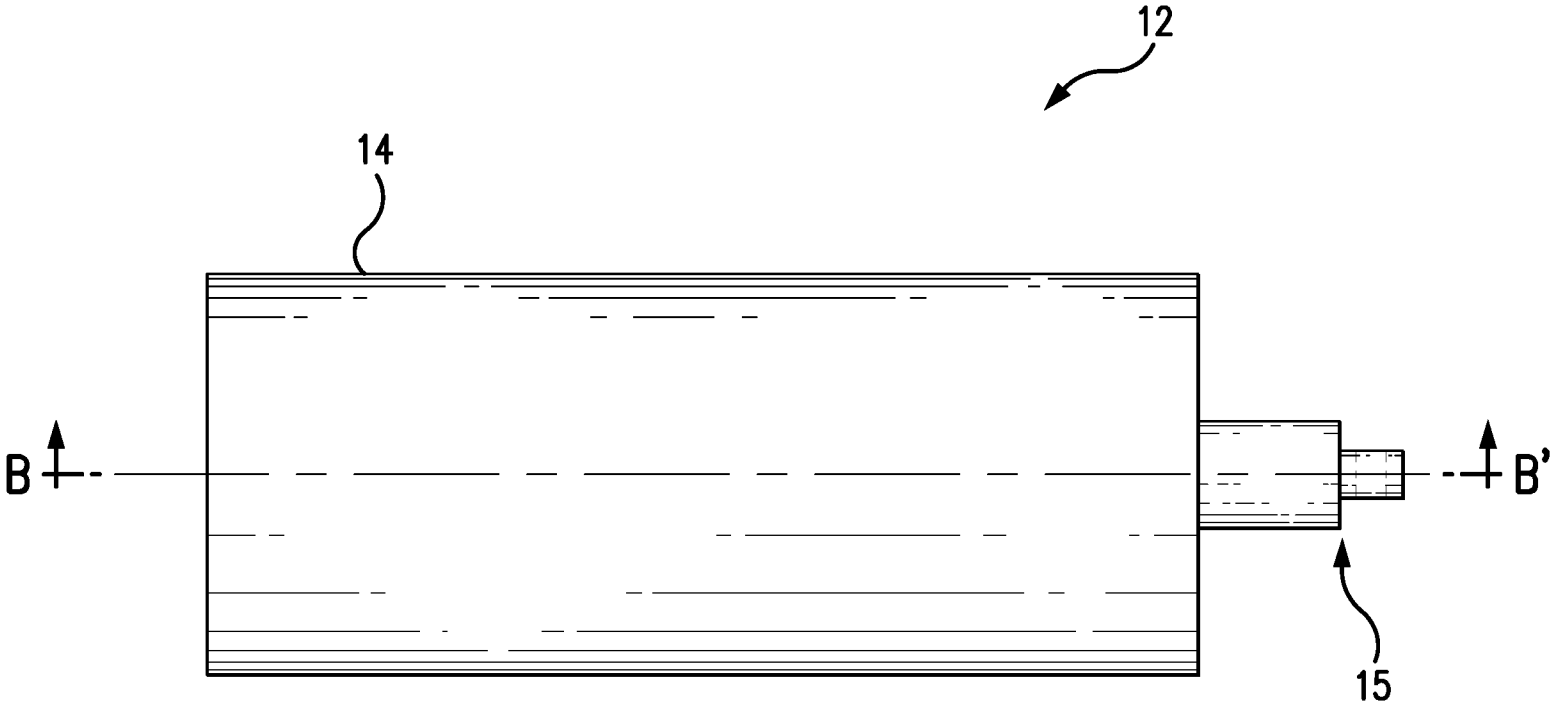
FIG. 3A is a top plan view of the exemplary piston spring mechanism of FIG. 2.

A perspective view of the exemplary piston spring mechanism 12 is depicted in FIG. 2, which shows the spring housing 14, the swivel support 13 and the tow rope connector shaft 15, to which a turnbuckle is attached as a means of connecting the tow rope 16. The top plan view of the exemplary spring mechanism 12 shown in FIG. 3A depicts the spring housing 14 and the tow rope connector shaft 15.

Figure 3C:
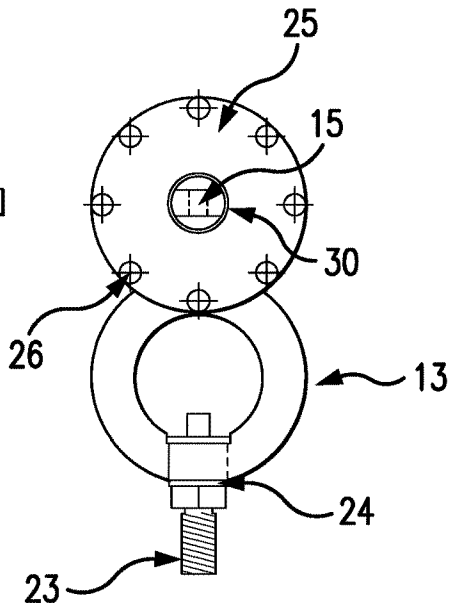
FIG. 3C is a front profile view of the exemplary piston spring mechanism.
Figure 3B:
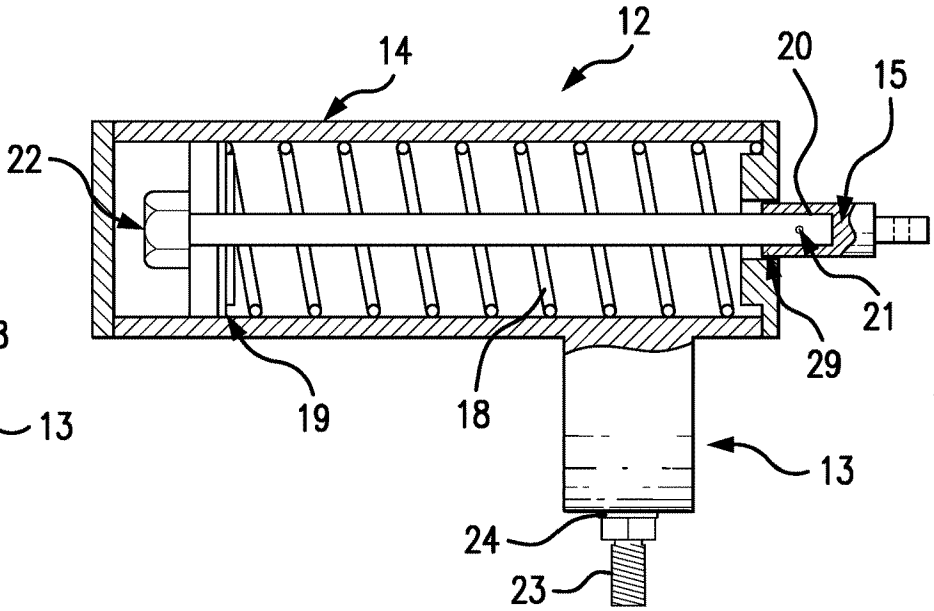
FIG. 3B is a cross-sectional view of the exemplary piston spring mechanism taken along the line B-B' in FIG. 3A.
Figure 3D:
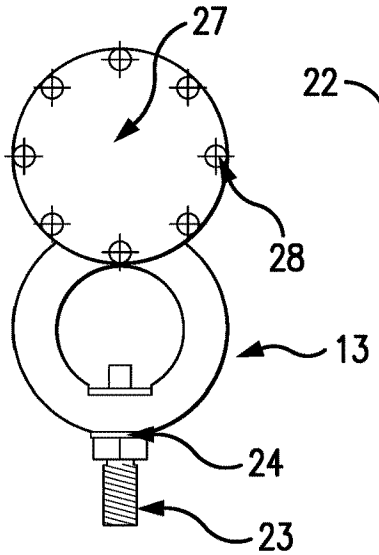
FIG. 3D is a rear profile view of the exemplary piston spring mechanism.

Referring to FIGS. 3B-3D, the internal components of the piston spring mechanism 12 comprise the helical spring 18 confined between the piston head 19 and the proximal end 29 of the spring housing 14. The motion of the piston head 19 is controlled by the piston rod 20, which has a proximal terminus 21 connected to the tow rope connector shaft 15 and a distal terminus 22 attached to the piston head 9 (by a retaining nut in this example). The swivel support 13 is rotably attachable to the towing tower 31 by a threaded connector 23 with a swivel bearing 24.

As shown in FIGS. 3C and 3D, the proximal and distal ends of the piston spring mechanism 12 are enclosed by a front cap 25 and a rear cap 27, respectively, which are connected to the spring housing 14 by multiple front cap screws 26 and rear cap screws 28. The tow rope connector shaft 15 protrudes through the shaft aperture 30 of the front cap 25.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A spring-loaded wakeboard booster apparatus comprising:

a wakeboard having a top surface and a bottom surface and having a proximal side and a distal side;

a piston spring mechanism comprising a substantially horizontal, cylindrical spring housing, having an upper face and a lower face, and having a proximal end and a distal end, a helical spring axially longitudinally oriented within the spring housing and confined between a piston head and the proximal end of the spring housing, a piston rod, having a proximal terminus extending through the proximal end of the spring housing, and having a distal terminus connected to the piston head, wherein the piston rod is operable to move the piston head from the distal end of the spring housing toward the proximal end of the spring housing, so as to compress the spring, and a tow rope connector shaft extending from the proximal end of the spring housing and connected to the proximal terminus of the piston rod, wherein the tow rope connector shaft is operable to connect the piston rod to a tow rope extending to the wakeboard; and a swivel support perpendicularly extending from the lower face of the spring housing and rotatably attachable to a top surface of a towing tower mounted on a stern of a motorboat, wherein the swivel support enables the piston spring mechanism to rotate in a plane parallel to the top surface of the towing tower.

2. The spring-loaded wakeboard apparatus according to claim 1, wherein the wakeboard is configured to be towed by the motorboat and to ride through and upon a wake generated by the motorboat, and wherein the piston spring mechanism is operable to store an energy expended in traversing the wake through a compression of the spring by the piston head as the piston rod is pulled toward the proximal end of the spring housing by a towing force exerted on the tow rope connector shaft, and wherein the piston spring mechanism is operable to release the energy stored in the compression of the spring upon the wakeboard reaching a crest of the wake, so as to propel the wakeboard over and above the wake.

* * * * *